United States Patent [19]

Petersson

[11] 4,361,979

[45] Dec. 7, 1982

[54] CONNECTION ELEMENT FOR MAKING ASSEMBLIES OF TOY UNITS

[75] Inventor: Nils A. I. Petersson, Killeberg, Sweden

[73] Assignee: Brio Toy AB, Osby, Sweden

[21] Appl. No.: 251,885

[22] Filed: Apr. 7, 1981

[51] Int. Cl.[3] ..... A63H 33/10; F16B 7/00

[52] U.S. Cl. ..... 46/26; 46/23; 403/297; 403/292

[58] Field of Search ..... 46/26, 29, 16, 17, 31, 46/23; 403/292, 297, 298, 293, 300

[56] References Cited

U.S. PATENT DOCUMENTS

| | | | |
|---|---|---|---|
| 2,313,307 | 3/1943 | Wilkinson | 403/297 X |
| 2,657,944 | 11/1953 | Miller | 403/297 |
| 3,195,266 | 7/1965 | Onanian | 46/29 X |
| 3,360,285 | 12/1967 | Huckshold | 403/292 |
| 4,068,346 | 1/1978 | Binder | 403/292 X |
| 4,170,083 | 10/1979 | Freelander et al. | 46/17 X |

*Primary Examiner*—Mickey Yu

*Attorney, Agent, or Firm*—Laurence R. Brown

[57] ABSTRACT

An element for detachably interconnecting toy units comprises two tubular parts separated by a radially extending flange.

The element is resilient in radial directions and each of its two parts is between its ends provided with sections having reduced outer diameter.

1 Claim, 5 Drawing Figures

FIG.1
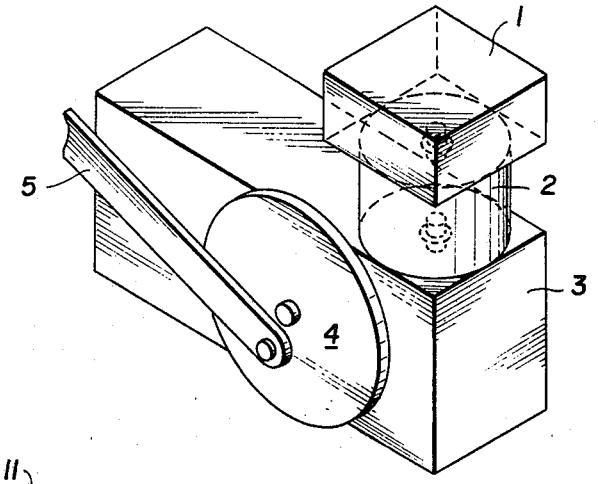
FIG.2
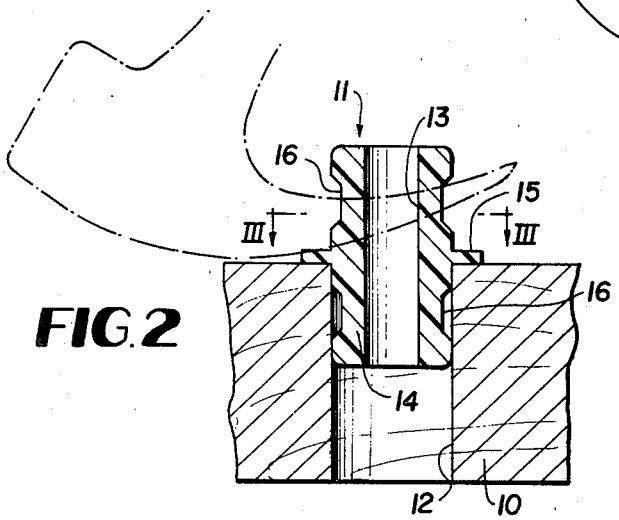
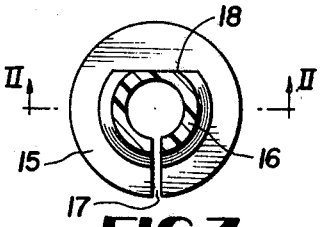
FIG.3
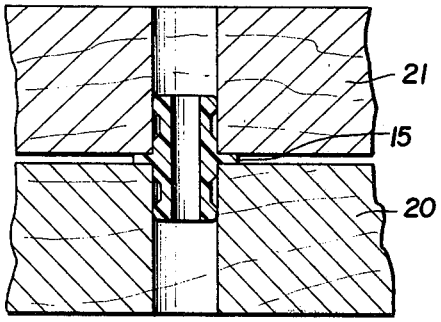
FIG.4
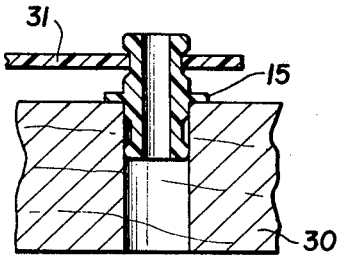
FIG.5

CONNECTION ELEMENT FOR MAKING ASSEMBLIES OF TOY UNITS

BACKGROUND OF THE INVENTION

1. Field of the Invention

This invention relates to a connection element for making assemblies of toy units provided with holes of substantially equal diameter, said connection element having parts of generally cylindrical shape and of a diameter to cause a tight fit when mounted in said holes.

2. Description of the Prior Art

For many years toy units have been sold in kits enabling children to make constructions of models simulating existing buildings, machines or animals or to make constructions of their own imagination. As examples the kits known under the trade names "Meccano" or "Tinkertoy" could be mentioned. However, the existing kits have the drawbacks that they either contain connection elements which may be difficult to fit or to remove, or they may contain connection elements of such clumpsy shape and great dimensions that the possibilities of making variations in the constructions are substantially reduced.

SUMMARY OF THE INVENTION

The object of the present invention is to design a connection element for making assemblies of toy units of the type referred to above, the inventive design making it possible to obtain a toy kit which does not have the drawbacks listed, and which may be applied and removed either completely manually or—in case of use by small or disabled children—with the aid of very simple and light tools. According to the invention these objects are obtained thereby that a flange of substantially larger diameter is provided between two of said parts of generally cylindrical shape being arranged coaxially, said flange extending in directions perpendicular to the common axis of said generally cylindrically shaped parts.

The accompanying drawing which is incorporated in and constitutes a part of this specification illustrates one embodiment of the invention and, together with the description, serves to explain the principles of the invention.

BRIEF DESCRIPTION OF THE INVENTION

FIG. 1 is a perspective view of a part of a toy set composed of toy units which may be assembled by elements according to the invention, FIG. 2 is a vertical section through an element according to the invention fitted into a hole in a toy unit, the section being taken along the line II—II of FIG. 3, FIG. 3 is a section along the line III—III of FIG. 2, FIG. 4 shows two toy units held firmly together by an element according to the invention, and FIG. 5 shows two toy units pivotally connected by an element according to the invention.

DETAILED DESCRIPTION OF THE DRAWINGS

FIG. 1 shows three box shaped toy units 1,2,3 of different dimensions. The reference numeral 4 designates a rather thin disc unit while a rod 5 is a further part of a toy assembly. All units may be made of wood and painted according to wish. The thinner units 4 and 5 may alternatively be made of synthetic resins.

The units 1,2,3 may be rigidly, but detachably interconnected by elements according to the invention. The units 4 and 5 may be pivotally connected by means of identical elements as will be explained below in connection with the FIGS. 2–5.

FIG. 2 shows a wooden unit 10 provided with a generally tubular element 11 which has been inserted in a hole 12 of standard diameter—e.g. 10 millimeters—in the unit 10 with a tight fit. The element 11 is made of an elastically deformable synthetic resin e.g. a polyamide. The element 11 has two generally cylindrical parts 13,14 arranged coaxially and symmetrically relative a rather thin, disc shaped flange 15 extending perpendicular to the parts 13,14. The element 11 has been pressed into the hole 12 until the flange 15 has engaged the upper surface of the unit 10. In this position the part 14 has been fully inserted in the hole 12 and contact is established between the cylindrical wall of the hole 12 and the outer cylindrical surface of the part 14 except for an axial section 16 having reduced diameter and being located between the two ends of the part 14. The part 13 has also an axial section 16 of reduced diameter.

In order to obtain greater resiliency the element 11 is provided with a continuous, axially extending slot 17 as well as a reduced thickness wall part 18 opposite the slot 17. The slot 17 also passes through the flange 15, but the reduced thickness wall part 18 is only a part of the sections 13 and 14.

Due to the character of the material chosen and to the slot and the reduced thickness wall parts 18 the element 11 may easily be fitted tight in any suitable standard hole made in the toy units. However small children or disabled children may need some kind of a tool e.g. a very light hammer (having a total weight of about 20 grams). The neck of such hammer may be split in a manner known per se for nail extraction and such split neck may be used for extraction of the element 11 if applied to the protruding axial section 16 of reduced diameter. The outlines of a hammer have been shown in dash dotted lines in FIG. 2.

FIG. 4 shows how two units 20 and 21 may be rigidly though detachably connected by an element according to the invention. The gap between the two units may be only 0.5 mm corresponding to the axial dimension of the flange 15.

FIG. 5 shows how an element according to the invention may be used for pivotally connecting two units 30 and 31. The pivot connection is obtained thereby that the unit 31 is thinner than the axial dimension of the reduced diameter portion 16.

The flange diameter is not critical for the function of the element, but could be used for increasing the size of the element. It is well known that toy elements should have certain minimum dimensions in order to avoid being swallowed by small children.

I claim:

1. A connection element for connecting together toy units to make assemblies of a plurality of toy units, each provided with holes of substantially equal diameter, said connection element comprising in combination, parts of elastically deformable material having generally cylindrical shape and of a diameter to cause a tight fit when mounted in said holes, a flange of substantially larger diameter than the cylindrical diameter provided between two portions of generally cylindrical shape being arranged coaxially, said flange extending outwardly in directions perpendicular to the common axis of said generally cylindrically shaped portions and adapted to abut and support opposed surfaces of two toy units to be held together by the connection element, each of said two generally cylindrically shaped portions having a reduced outer diameter cylindrical axial section between its end and a spaced distance from the flange adapted to retain mount and bear thereon plate members to freely pivot without interference with adjacent toy units and to mate with apertures in the plate members of thickness less than the reduced outer diameter axial length, said portions and flange defining a continuous hole therethrough coaxial with the cylindrical portions and a slot through the axial length of the portions and flange to provide greater resiliency for positioning in the toy unit holes, said element is further provided with a single axially extending reduced thickness wall part located opposite said slot at each of the two said portions of generally cylindrical shape, but not the flange.

* * * * *